United States Patent [19]

Schultz et al.

[11] Patent Number: 4,913,069

[45] Date of Patent: Apr. 3, 1990

[54] BATCH PYROLYSIS SYSTEM

[75] Inventors: Thomas J. Schultz, Maumee; Klaus H. Hemsath, Toledo; Franklin G. Rinker, Perrysburg; Jay K. Shah, Sylvania, all of Ohio

[73] Assignee: Surface Combustion, Inc., Maumee, Ohio

[21] Appl. No.: 324,738

[22] Filed: Mar. 17, 1989

[51] Int. Cl.[4] ..... F23G 5/12

[52] U.S. Cl. ..... 110/346; 110/185; 110/211; 110/212; 110/214; 110/229; 110/213

[58] Field of Search ..... 110/211–214, 110/229, 230, 185, 346; 431/5

[56] References Cited

U.S. PATENT DOCUMENTS

| | | | |
|---|---|---|---|
| 3,838,974 | 10/1974 | Hemsath et al. | 23/277 C |
| 3,909,953 | 10/1975 | Hemsath et al. | 34/26 |
| 4,485,745 | 12/1984 | Bracker et al. | 110/229 |
| 4,734,166 | 3/1988 | Angelo, II | 110/214 X |
| 4,797,091 | 1/1989 | Neumann | 110/229 X |
| 4,799,878 | 1/1989 | Schaeffer | 110/212 X |
| 4,821,653 | 4/1989 | Jones | 110/229 |

OTHER PUBLICATIONS

Chapter 12.7–Pyrolysis Processes by J. K. Shah, T. J. Schultz and V. R. Daiga; 11–1988.

*Primary Examiner*—Edward G. Favors

*Attorney, Agent, or Firm*—Body, Vickers & Daniels

[57] ABSTRACT

Method and apparatus is disclosed for thermally decomposing waste material from several batch furnaces plumbed into one afterburner. The afterburner is modified to mix and combust in a controlled manner an otherwise explosive mixture of fumes from several furnaces. The entire system is regulated only by the temperature of incinerated gases from the afterburner. The furnaces are operated in a sequenced, overlapping staged manner to produce a generally constant fume loading permitting significant cost savings in equipment and operation.

10 Claims, 6 Drawing Sheets

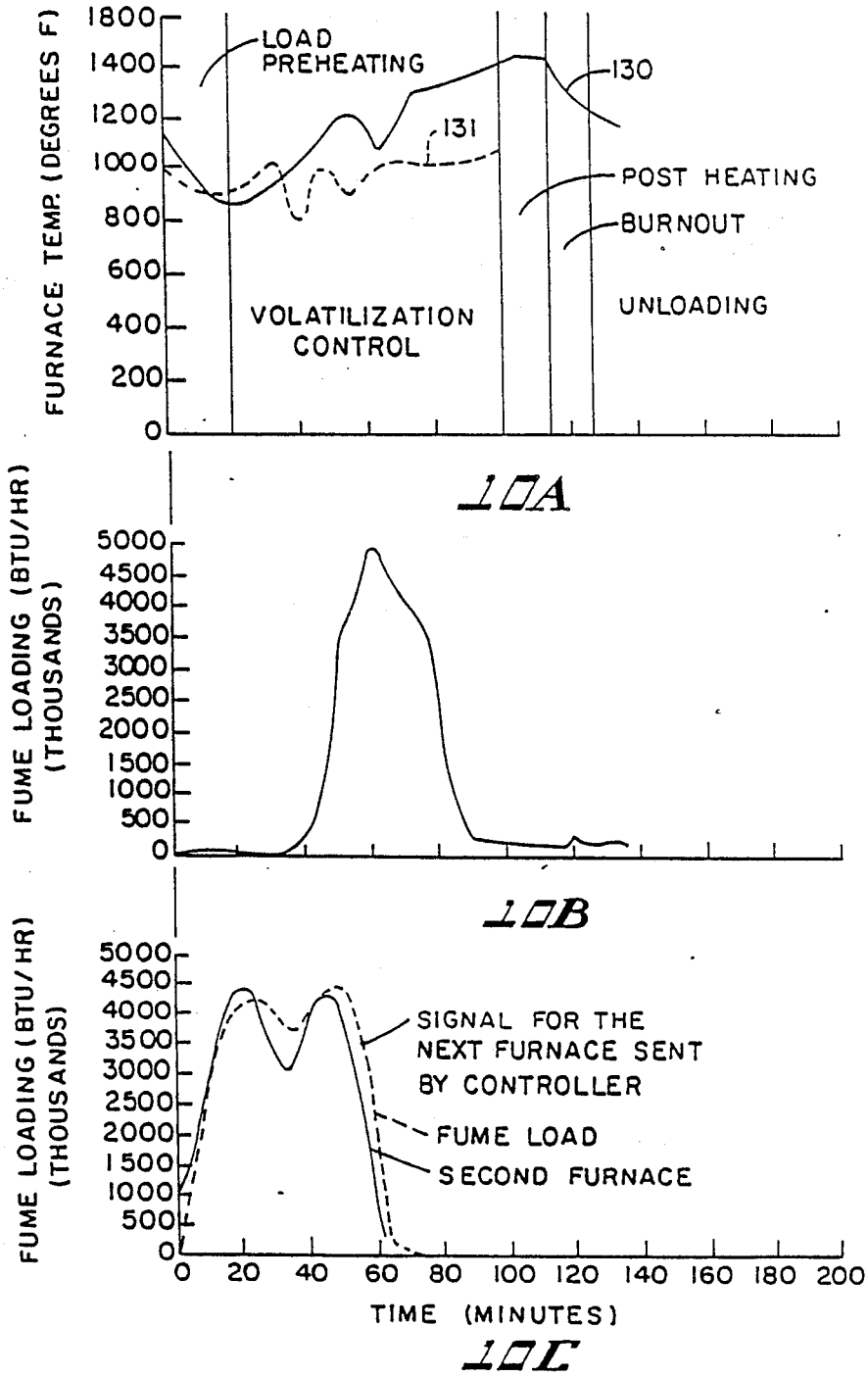
FURNACE TEMP. (DEGREES F)
1800
1400
1200
1000
800
600
400
200
0
LOAD PREHEATING
130
131
POST HEATING
BURNOUT
VOLATILIZATION CONTROL
UNLOADING
10A
FUME LOADING (BTU/HR) (THOUSANDS)
5000
4500
4000
3500
3000
2500
2000
1500
1000
500
0
10B
FUME LOADING (BTU/HR) (THOUSANDS)
SIGNAL FOR THE NEXT FURNACE SENT BY CONTROLLER
FUME LOAD
SECOND FURNACE
0 20 40 60 80 100 120 140 160 180 200
TIME (MINUTES)
10C

BATCH PYROLYSIS SYSTEM

The government has rights in this invention pursuant to Contract DAAK11-80-C-0072 and also under Contract DAAK11-82-C-0056 awarded by the U.S. Army Armament, Munitions and Chemical Command. The invention described herein may be manufactured, used and licensed by or for the government for governmental purposes without the payment to us of any royalty thereon.

This invention relates generally to thermal destruction of waste materials by pyrolysis and more particularly to pyrolysis conducted in the batch processing mode.

The invention is particularly applicable and will be explained in detail with reference to a system for operating multiple batch furnaces. However, it will be appreciated by those skilled in the art that the invention may have broader application in that certain components of the system, modified for multiple furnace use, could also have application for use in single batch furnaces.

INCORPORATION BY REFERENCE

The following material is incorporated by reference herein:

(1) Chapter 12.7 entitled "Pyrolysis Processes" of *Standard Handbook for Hazardous Waste Treatment and Disposal,* published November, 1988 by McGraw Hill, edited by H. M. Freeman and authored by certain of the inventors hereof;

(2) U.S. Pat. No. 3,838,974 which issued Oct. 1, 1974 to Hemsath et al; and (3) U.S. Pat. No. 3,909,953 which issued Oct. 7, 1975 to Hemsath et al.

BACKGROUND

The literature in the pyrolysis art frequently uses terminology which is incorrect or misleading. For purposes of explaining this invention, some general understandings with respect to the terminology used herein and as used in the claims hereof will have the meanings set forth herein. "Pyrolysis", in a technical sense, means the chemical decomposition or change in a material brought about by heating the material in the absence of oxygen. In the commercial application of pyrolysis, this cannot occur because of oxygen or air leakage inherent in commercial furnaces used to pyrolyze waste material. To prevent leakage of fumes from the furnace into the work place, pyrolyzing furnaces are typically operated at a slight negative pressure which results in air being drawn into the furnace. Typically, the furnace pressure is controlled so that no more than about 2% of the furnace atmosphere during the pyrolyzing stage is oxygen. "Pyrolysis" as thus used herein does contemplate that a slight percentage of oxygen will be present in the furnace atmosphere during the process. Accordingly, the specifications hereof will discuss the pyrolysis process along the classical heat transfer lines of whether or not the thermal reactions occurring within the furnace are endothermic or exothermic. The atmopshere within the furnace or the fumes which are drawn off from the furnace will then be discussed with reference to the percentage of the volatiles present in the fumes, it being understood that when the furnace is operating in the pyrolyzing mode, the oxygen content of the fumes emitted from the furnace is a very slight amount and is maintained at a level which will not permit the fumes to have an oxygen content usch that the mixture is combustible. This occurs only during the pyrolyzing mode.

Other terms which tend to be confused in the art include "stoichiometric" and "starved air" or "starved combustion". "Stoichiometric" is technically defined as an adjective characterized by being that portion of substances exactly right for a specific chemical reaction to occur with no excess of any reactant or product. The term "stoichiometric" is typically used in the burner art to mean that metered amounts of fuel and combusion air are supplied to the burner so that the fuel is completely combusted by the precise amount of air provided. "Starved air" or "starved combustion" means that the air or oxygen is supplied at a rate which is less than stoichiometric when compared to the amount of oxygen required for stoichiometric combustion of the material. Arbitrarily, starved air means oxygen supplied at a rate equal to anywhere from 40–99% of the oxygen required to achieve stoichiometric combustion. Having thus defined such terms, the definitions are admittedly of slight value because under the starved air mode an endothermic reaction can become exothermic as a function of time because over a fixed time period a given quantity of oxygen will be supplied to the reactants. The definitions are nevertheless helpful to distinguish incinerator apparatus operated in a starved air mode and erroneously referred to as a pyrolyzer. Reference may be had to U.S. Pat. No. 4,649,834 to Heran describing a water activated temperature control system for a pyrolyzer which, in fact, appears to be a furnace operated under starved air conditions. Reference may also be had to U.S. Pat. Nos. 4,474,121 and 4,517,906 to Lewis which discuss starved air combustion in terms of stoichiometric relationships and identifies the pyrolysis misnomer applied to such processes. Such distinctions become significant when considering the control aspects of the present invention.

Insofar as pyrolyzing processes are concerned, the present inventors have developed and perfected for batch type pyrolyzing furnaces a two-step process. The process comprises an endothermic first step where pyrolysis occurs followed by an optional "burnout" step which incinerates or burns the residue or char remaining from the waste after pyrolysis. The endothermic step is generally conducted at temperatures between 250°–1400° F. and the exothermic step is generally conducted at temperatures between 1400°–2500° F. This is the general pyrolysis batch process as conventionally practiced by the inventors and includes an afterburner for combusting the volatiles distilled from the waste during the pyrolyzing step. As alluded to above, the reason for dividing the process into two steps is to permit the endothermic step to be controlled. In the starved air systems discussed above, the reactions which are both exothermic and endothermic cannot be controlled. This is the reason for many of the control schemes present in the prior art which are then necessary to prevent the waste material from generating high rates of heat and producing a "runaway" situation which can easily result in an explosion.

In the published art, it is generally accepted that pyrolysis is defined as a two-step process in the sense that waste is pyrolyzed in a first step and the fumes or volatiles emitted from the waste are combusted in an afterburner in a second step. The burnout step is generally not practiced or, if practiced, there is no significant distinction or accommodations made in the equipment to handle the exothermic reaction.

Insofar as controlling the endothermic reactions, the inventors have developed for use in their pyrolyzing batch furnaces, a concept defined herein as "signature heat profile". Insofar as it is pertinent to the discussion of the prior art as practiced by the inventors, it is known to take a sample of a waste specimen and pyrolyze the specimen at various temperatures while recording the weight loss of the specimen in a gravimetric furnace until volatilization is achieved in optimal processing times. The time-temperature graph for the specimen, i.e. the heat profile, thus obtained in the gravimetric furnace then becomes the "signature" which is programmed into the commercial pyrolyzing furnace for treating that particular waste. In this manner, batch pyrolyzing of complex, heterogeneous waste material (including many hazardous and toxic substances) containing competing reactions has been successfully accomplished. Because of variations in the waste in commercial applications, the inventors have developed a control arrangement for single pyrolyzing batch furnace applications where a specific type of prior art incinerator (described in patents incorporated by reference herein) is used to incinerate the fumes and the temperature of the incinerator gas is utilized as the only control to check the progress of the pre-programmed signature profile. Specifically, when the temperature of the incinerator gases begin to rise above a predetermined level, the pre-programmed heat profile is interrupted and the burner firing rate retarded at the pyrobatch furnace until the process is under control at which time the profile is reactivated. This arrangement produced a very simple control concept which has been successfully demonstrated in commercial applications involving an afterburner connected to a single batch furnace. The signature heat profile concept gradually evolved over a period of several years by the inventors and ramifications of the concept are still being made, one of which forms a feature of this invention and will be described in detail hereafter.

While there are virtually a countless number of afterburners or incinerators which have been used in the prior art to incinerate the fumes given off in the pyrolysis process, the inventors have heretofore used for their batch furnace applications a particular incinerator of the type described in U.S. Pat. No. 3,838,974, incorporated by reference herein. In that arrangement, a jet pump annulus of cold combustion air pulls the fumes from the pyrolyzer into a combustion chamber whereat the jet expands into contact with the combustion chamber walls to produce turbulence. The turbulence causes mixing of the fumes and the combustion air to produce a mixture capable of sustaining combustion which is stabilized, ignited and combusted in the incinerator. Burners are added to the combustion chamber to ignite the mixture during start-up and afterwards to supply metered amounts of air or combustibles to maintain the mixture being incinerated at the desired temperature. The temperature variation of the incinerator gases as sensed by a thermocouple in the rich fume incinerator is thus a function of the volatile content of the fumes emitted from the pyrobatch furnace in contrast to other afterburner control arrangements. Thus, one temperature sensor which controls the operation of the incinerator also insures that the pyrolysis in the batch furnace is proceeding in the proper manner.

While the batch furnace, as thus described, has successfully operated to optimally process complex and rather exotic toxic and/or hazardous waste materials in short time periods, each pyrolysis batch furnace required a rich fume incinerator, a control arrangement, and associated pollution control equipment. Commercial waste treating facilities dispose of many types of hazardous waste. Treating a variety of waste means different signature profiles which result in the batch furnaces processing loads smaller than that desired for optimal equipment utilization. Preferably, for industrial and commercial waste treaters small size batch furnaces are preferred. However, the equipment cost begins to significantly rise not only because each furnace requires its own incinerator, but also, because each incinerator requires its own pollution control equipment such as scrubbers and the like. Heretofore, it was not possible to plumb several batch furnaces into one incinerator with its related equipment simply because if a burnout step was occurring in any one furnace, streams containing air would mix with volatiles in other streams producing an explosive mixture. Secondly, considering systems that operate only in the pyrolysis stage without any burnout, the afterburner and pollution control equipment would have to be sized for the total cumulative furnace load the afterburner would be exposed to, and while the capital cost of one large afterburner compared to many small ones would be reduced, the equipment cost is still significant.

SUMMARY OF THE INVENTION

It is thus one of the principal objects of the invention to provide a pyrolysis system which uses only one afterburner with its associated pollution control equipment to economically process fumes simultaneously produced from multiple batch furnaces.

This object along with other features of the invention is achieved by a pyrolysis type, thermal decomposition system which has a plurality of batch type furnaces, each furnace heating waste type materials in a controlled manner such that the waste materials produce fumes exhausted from an outlet in each furnace as the waste is decomposed by thermal reaction. Only one afterburner is provided for incinerating the fumes produced by a plurality of the furnaces as the waste materials are heated in the furnace. The furnaces are operated to pyrolyze the waste in a sequentially staged, overlapping manner to produce a generally constant supply of fumes to the afterburner such that the afterburner as well as the pollution equipment downstream of the afterburner can be optimally sized on a throughput basis which is substantially less than that which would otherwise occur on a peak load basis.

In accordance with a more specific aspect of the invention, the process completed in each furnace entails heating the waste material in an endothermic reaction followed by "burnout" or incineration of the waste materal in an exothermic reaction which occurs in the presence of excess combustion air. Each fume outlet for each furnace is separately ported into a rich fume incinerator of the type described above which has been especially modified, in any one of several ways, to provide mixing of the composite streams within the combustion chamber of the afterburner prior or simultaneously with ignition and combustion of the composite stream. In this manner, fume streams from the pyrolyzer which otherwise would produce an explosive mixture are combined in a safe and efficient manner to permit optimal use of the pyrolyzing processes for multiple batch furnace installation.

In accordance with yet another specific feature of the invention, each pyrolyzing furnace is controlled by the signature heat profile for the particular waste material pyrolyzed in the furnace as discussed above. However, the particular profile shape for the waste material is developed in a manner which produces a relatively constant discharge of volatiles during the endothermic step to permit overlapping sequencing of the batch furnaces as set forth above. Importantly, the relatively flat volatile output curve permits the preheat stage of the endothermic cycle to be controlled in a manner which prevents "spiking" at the initial point of distillation or volatilization, a critical point in the pyrolysis of any waste material.

Still another specific feature of the invention resides in the controller which simultaneously regulates several furnaces in accordance with the signal generated by the incinerator's thermocouples. Specifically, the signature profiles (both the signature heat profile and the signature load profile) are programmed into the controller for each furnace and the cumulative, calorimetric fume loading is correlated to the temperature of the composite fume stream incinerated at the afterburner. The signature heat profiles for each furnace are staged in such a manner that the controller is able to determine which specific furnace requires its signature heat profile to be overridden based on the composite fume temperature in the afterburner and adjusts the burner output accordingly. In this manner, only the temperature of the incinerated composite fumes need be sensed to control simultaneously multiple batch furnaces in a manner similar to that heretofore accomplished when a single batch furnace was plumbed to a single afterburner as described above.

Yet another specific feature of the invention is a preferred modification to the prior art rich fume incinerator which includes pressurizing the fume streams and separately porting the streams in an axially aligned plane into the interior wall of the incinerator's combustion chamber. Specifically, the streams enter the combustion chamber tangentially to the interior wall thereof and produce a swirling band of fumes which are immediately and thoroughly mixed into a composite fume stream. Should the composite fume mixture be combustible (an abnormal case), combustion will occur uniformly in the combustion chamber where it normally occurs. Should the mixture not be combustible (the normal case), a cold combustion jet formed as a free standing annular jet is admitted axially at the inlet of the chamber. The annular jet is sized to expand and impact the swirling composite fuel stream to cause thorough mixing of the composite fuel stream with combustion air to cause a combustible mixture to occur. The combustible mixture is then stabilized, ignited, and combusted within the incinerator in a manner not entirely dissimilar to the prior art rich fume incinerator. The calorimetric value of the composite fuel stream is predetermined to generate a signature fume load profile controlling the flow of combustion air into the incinerator so that complete incineration of all the fumes occurs in the normal incinerator operating mode.

It is thus an object of the invention to provide a system, method and apparatus, where one afterburner with its related pollution control equipment combusts the fumes produced by a plurality of simultaneously operating batch pyrolyzing furnaces.

It is another object of the invention to provide a simple and cost effective multiple batch furnace system for pyrolyzing waste.

It is yet another object of the invention to provide a plurality of furnaces for pyrolyzing waste during which the thermal decomposition of the waste material processed in such furnaces is accurately controlled to permit an increase in the processing capability of each batch furnace in the system and/or optimal processing times for thermal treatment of the waste.

It is yet still another object of the invention to provide a multiple batch furnace arrangement for thermal destruction of waste and like material which uses the temperature sensed at the afterburner in the arrangement to control, simultaneously, the thermal processes underway in the batch furnaces.

Still yet another feature of the invention is to provide an improved afterburner for use with multiple batch furnaces.

Still yet another feature of the invention is to provide a simple, cost effective arrangement downstream of a series of multiple batch furnaces for treating the fumes emitted from the furnaces.

Further objects and advantages of the invention will become apparent to those skilled in the art upon a reading and understanding of the following detailed description of the invention.

BRIEF DESCRIPTION OF THE DRAWINGS

The invention may take physical form in certain parts and arrangement of parts, a preferred embodiment of which will be described in detail and illustrated in the accompanying drawings which will form a part hereof and wherein:

FIGS. 10*a*, 10*b* and 10*c* are graphs illustrating the relationship between fume loading produced by the pyrolyzing furnaces for two different types of waste contrasted to the temperature profile developed in the furnace for the waste.

DETAILED DESCRIPTION OF THE INVENTION

Figure 1:
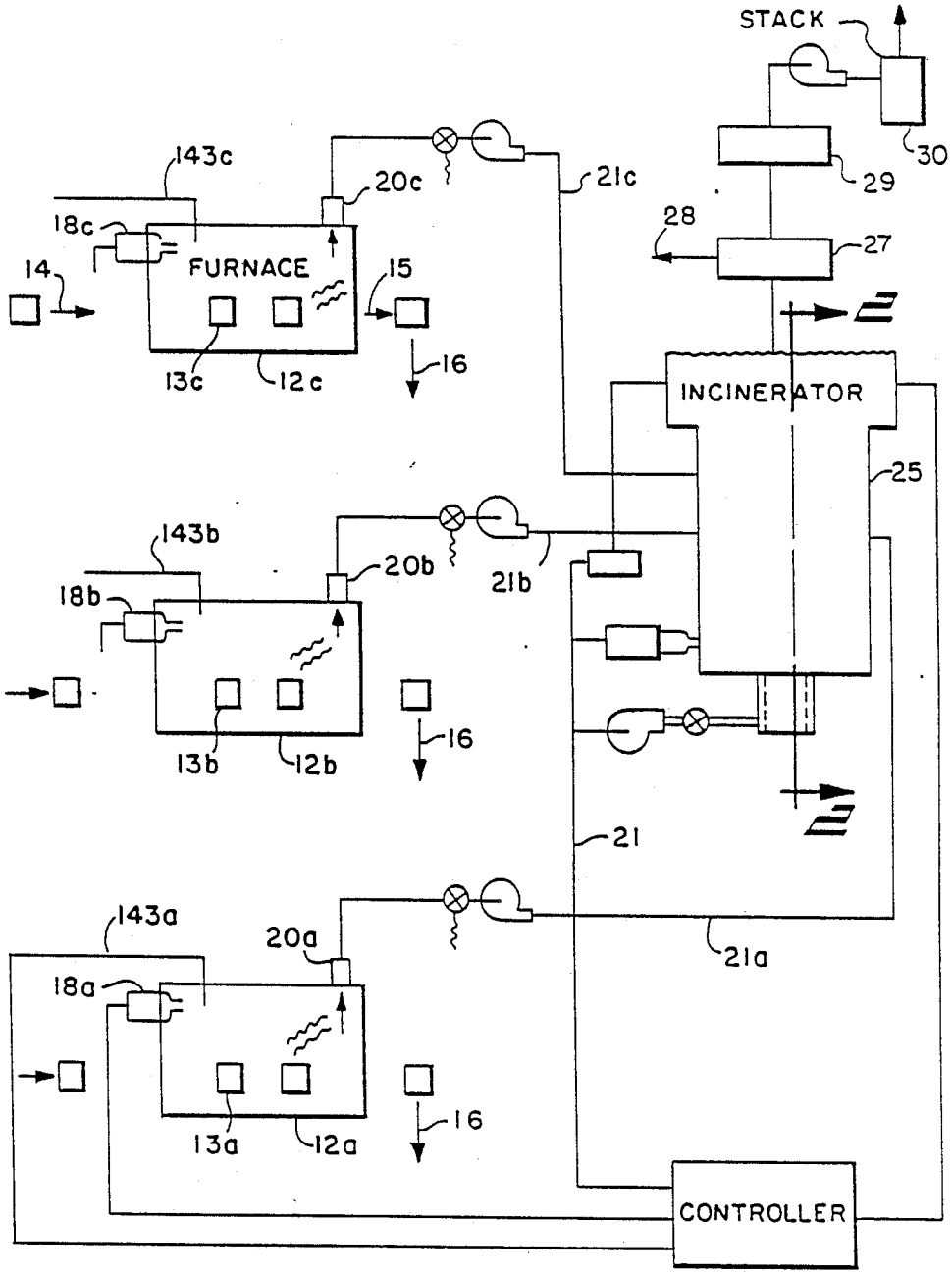
FIG. 1 is a schematic diagram with a multiple batch furnace system of the present invention.

Referring now to the drawings wherein the showings are for the purpose of illustrating preferred embodiments of the invention only and not for the purpose of limiting same, there is generally shown in FIG. 1 a schematic illustration of a multiple batch furnace system 10 for thermally decomposing waste material, preferably by pyrolysis. Except as noted and discussed herein, system 10 comprises components which are readily known and available to those skilled in the art and such components, except for their identification, will not be described or discussed in detail herein.

System 10 includes a plurality of batch furnaces 12. At a minimum, system 10 must use at least two batch furnaces 12 and theoretically there is no upper limit to the number of furnaces. As a practical limitation and considering the variations in signature heat profiles for differing wastes, four to five furnaces would be a practical maximum upper limit. The system shown in FIG. 1 is a three furnace system and letters, a, b and c appearing as subscripts to numerals will identify the first, second and third furnaces and associated equipment respectively. Since the furnaces are essentially identical, only one furnace will be described and the letter subscript designation will be used throughout when it becomes important to distinguish one furnace arrangement from the other.

By definition, batch furnace 12 is a box-like enclosure into which a discrete or fixed amount of waste material is placed and the waste is heated until it is thermally decomposed. The waste which can be treated by system 10 can be either solid or liquid or a combined "sludge" mixture and preferably is of the toxic and/or hazardous type as contrasted to municipal wastes. That is, while system 10 can dispose of municipal waste and while certain municipal waste can be defined as hazardous, and while conventional incinerators can be used to dispose of toxic and/or hazardous waste, system 10 has particular commercial utility for treating waste which cannot be disposed of by incineration per se (exothermic reaction with excess air). The waste materials which system 10 typically processes are chemical munitions which must be periodically destroyed, pharmaceutical waste, waste by-products produced by chemical manufacturing companies, drummed wastes which exist at thousands of clean-up sites throughout the country etc.

To explain the waste material flow (arrows 14 and 15) of system 10 shown in FIG. 1, the waste material is contained in drums, i.e. drummed waste 13. The waste flow in system 10 is such that a plurality of drums 13 as shown by arrows 14 is collected at the entrance end of each batch furnace 12, and a discrete number of drums 13 are placed in each batch furnace 12 and are thermally destroyed, drum casing as well as the drum contents. In that case, an ash is left which is sometimes sold as a fertilizer. Alternatively, it is possible to thermally decompose the waste in the drum and leave the drum. Arrows 15 simply indicate the flow path of the residue or alternatively the cleaned drums leaving the exit end of batch furnace 12.

For ease of explanation, each batch furnace 12 is shown heated directly by a fuel-fired burner 18. Other conventional heating arrangements are possible. For example, a burner 18 could indirectly heat drummed waste 13 or, alternatively, electrical heating elements could be employed or, further, induction heating could be used. As drummed waste 13 is heated, fumes are generated while drummed waste 13 decomposes and are drawn off from each batch furnace 12 through fume outlet 20 for further treatment. More specifically, the waste material is organic and is volatilized or distilled as it is heated in a pyrolyzing sense. The volatiles have a colarific content and are incinerated in an afterburner or incinerator 25. (The terms "incinerator" and "afterburner" while technically distinct are used interchangeably throughout the specification and mean the device 25 shown and described herein.) In system 10, each fume outlet **20*a*, 20*b* and 20*c* is plumbed by a separate line 21*a*, 21*b* and 21*c*, respectively, into incinerator 25. Separately plumbing fume outlet 20 prevents any of the fumes from any of the furnaces 12 from co-mingling with one another until placed in incinerator 25. Incinerator 25 operates to raise the temperature of fumes to a predetermined level for a predetermined time period to reduce various gaseous compounds to simpler elements not harmful to the environment. The incinerated gases are then passed conventionally through a heat exchanger 27 and pollution control equipment designated generally by box 29 before passing through stack 30 to the atmosphere as harmless elements. The heat recovered from heat exchanger 27 indicated generally by arrows 28 is conventionally used in the process such as, for supplying preheat to the combustion air used on the burners, or by indirectly heating the batch furnaces or supplying heat to waste heat boilers and the like. The pollution control equipment 29 is typical of equipment which remove certain gaseous elements from the gas stream before exhausting to atmosphere such as scrubbers for sulphur removal, metal vapor collecting equipment, etc. While heat exchanger 27 and pollution control equipment 29 are per se conventional, as will be explained in detail hereafter, system 10 is generating or will generate a constant or relatively stable incinerator output while batch processing the waste material and this allows economies of scale in designing or sizing conventional items 27, 29. To some extent, the stability is inherent in the incinerator design. However, the staging of furnaces 12*a*, 12*b* and 12*c* effectively balance out the "burnout" stage occurring in any one of the furnaces so that the incinerator remains constantly in operation in a fuel saving mode. Thus recovered heat from heat exchanger 27** is constantly available at a consistent temperature-flow rate and does not have to be "stored".

THE INCINERATOR

As noted above, system 10 provides that the fumes from batch furnaces 12 be separately plumbed to incinerator 25 so that there is no co-mingling of the fumes from different furnaces and thus there is no possibility that should one particular furnace be in an excess air operating mode it will be combined with another furnace in an endothermic operating mode so that a gaseous mixture having an oxygen content capable of ignition does not occur prior to entering incinerator 25. Of course, separately plumbing the fumes into the common incinerator 25 will not resolve the problem of an explosive mixture within incinerator 25 or, in the absence of an explosive mixture, the stability of the incinerator to thoroughly combust different streams having different volatile compositions.

As noted above, one of the present inventors developed an incinerator capable of incinerating a fume mixture having a varying volatile content, but which volatile content was principally characterized as being "rich". This incinerator is disclosed in U.S. Pat. No. 3,838,974 incorporated by reference herein and will hereafter be referred to as the "prior art rich fume incinerator". The use of the prior art rich fume incinerator in a paint drying process which generated paint fumes, high in volatiles, is disclosed in U.S. Pat. No. 3,909,953 which is also incorporated by reference herein. The prior art rich fume incinerator design is ideally suited for batch pyrolysis processes since the volatile content of the fumes emitted during the pyrolysis step varies and the rich fume incinerator automatically adjusts for the variation to maintain a constant incineration temperature-residence time relationship. Specifically, the heating content of the volatiles is used to provide the fuel for the incineration and the prior art rich fume incinerator only supplies the differential btu value in the form of additional fuel needed to raise the gases to the appropriate incineration temperature. For this reason, the prior art rich fume incinerator represents advances over different types of afterburners or incinerators conventional in the art. However, when multiple batch furnace system 10 was in the process of development, it was recognized that even though the fumes from multiple batch furnaces 12 would be separately plumbed into the central part of the rich fume incinerator, the possibility of a combustible mixture occurring at that point would render the rich fume incinerator inoperable. That is, a combustible mixture of the separate fume streams could occur prior to the time the mixture was to be combusted in the incinerator or, if a combustible mixture did not occur, the volatiles would not be distributed evenly within the incinerator proper with the result that uneven and erratic combustion would occur.

Figure 2:
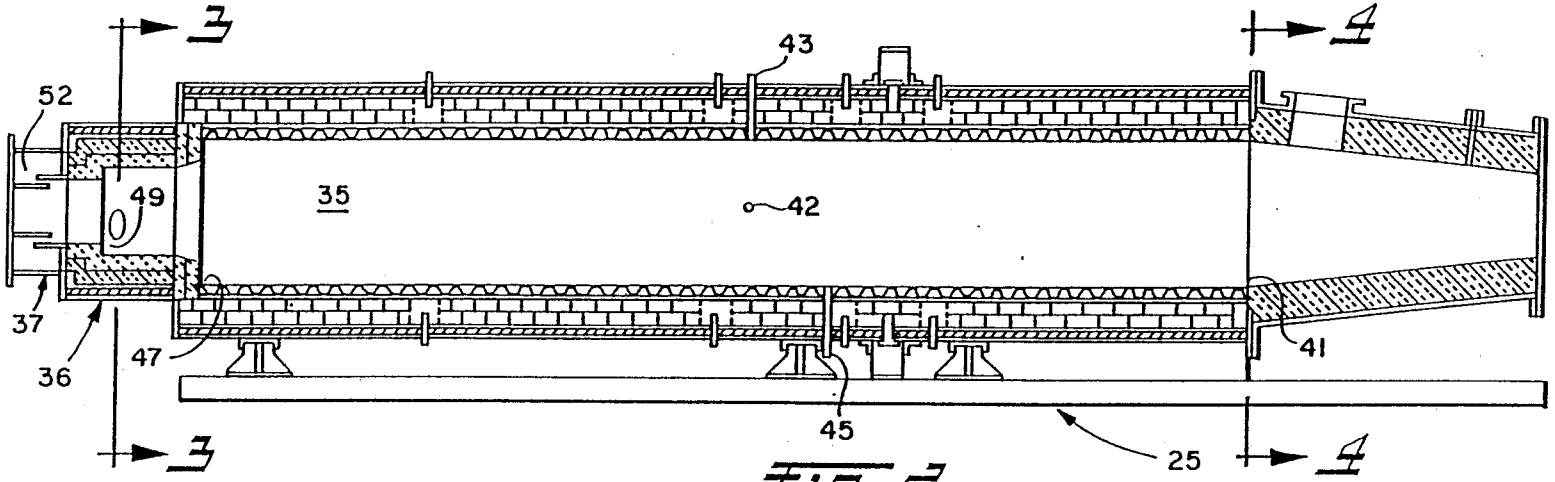
FIG. 2 is a cross-sectional view of an afterburner taken along lines 2—2 of FIG. 1.

Referring now to FIGS. 2, 3, 4 and 5, there is shown a modification to the rich fume incinerator which renders the incinerator usable for the multiple batch system 10 disclosed herein. Incinerator 25 includes a cylindrical residence chamber 35 at one end of incinerator 25. While cylindrical configurations are shown, other tubular shapes, such as rectilinear, are possible. A cylindrical combustion chamber 36 is attached to the opposite end of the residence chabmer 35 and a cylindrical inlet chamber 37 is positioned at the other end of incinerator 25 and extends from combustion chamber 36. Residence chamber 35 extends a fixed longitudinal distance from combustion chamber 36 before terminating at the exit end 41 of incinerator 25. The distance is calculated relative to the velocity of the gases travelling through residence chamber 35 to assure that the gases will be at a temperature for a sufficient residence time to insure incineration. Spaced from exit end 41 are two thermocouples 42, 43 which extend into residence chamber 35. Thermocouples 42, 43 are spaced 90° apart and sence an average temperature of the incinerator gases within residence chamber 35 for control purposes. Also, positioned in residence chamber 35 is an oxygen probe 45 which is used as a safety override device. Residence chamber 35 is shown in FIG. 2 to have a larger diameter than that of combustion chamber 36. Thus, a step 47 is formed at the intersection of residence chamber 35 and combustion chamber 36. Step 47 provides a lee or a dead spot to promote further mixing of the combusted mixture leaving combustion chamber 36 should, for whatever reason, there be some incomplete mixing or combustion of the fume mixture as it leaves combustion chamber 36. Step 47 is an optional or an auxiliary feature which is not necessary to the working of incinerator 25 and in the preferred embodiment of incinerator 25, the diameter of combustion chamber 36 is equal to that of residence chamber 35. Step 47 is disclosed in FIG. 2 simply as an auxiliary feature to make positively certain that the composite fume mixture is, in fact, combusted after it leaves combustion chamber 36.

Figure 3:
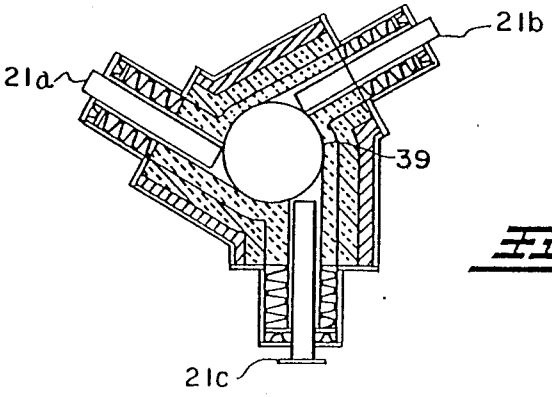

Combustion chamber 36 is modified as best shown in FIG. 3 so that fume ducts 21*a*, 21*b*, 21*c* are positioned to tangentially exhaust their fumes about the inner cylindrical wall 39 or interior of combustion chamber 36. The fumes from each batch furnace 12*a*, 12*b* and 12*c* thus do not communicate with one another until they are exhausted into combustion chamber 36 in a swirling, co-mingling manner. Formed in the interior of combustion chamber 36 at the entry end is an annular recess or step 49 and fume ducts 21*a*, 21*b* and 21*c* are orientated in a plane longitudinally spaced from but relatively close to annular step 49. Thus, when the fumes from batch furnace 12 are tangentially swirled in combustion chamber 36 they immediately mix and longitudinally expand about the interior wall 39. The expansion in one longitudinal direction will result in the mixture contacting step 49. If the fume mixture was of a character which could support combustion, then upon contact with step 49 further mixing would occur and ignition and combustion would occur at the "lee" 48 in step 49 pursuant to known prior art rich fume incinerator principles.

Figure 4:
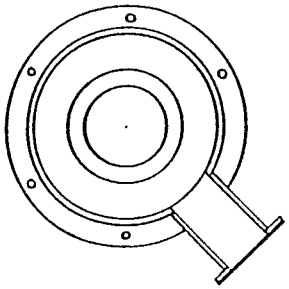
FIGS. 3 and 4 are further sectioned views of the afterburner taken along lines 3—3 and 4—4 respectively of FIG. 2.

Inlet chamber 37 is also a modification of the rich fume prior art incinerator and incorporates an optional feature which can be included in system 10. More particularly, and as best shown in FIGS. 2 and 4, longitudinally extending, cylindrical baffles form an annular passageway 50 which communicates with a source of relatively cold combustion air, the entry end of which is designated by numeral 52. Cold air annular passageway 50 surrounds a cylindrical passage 53. It is contemplated that cylindrical passage 53 is in communication with recovered heat designated by arrow 28 from heat exchanger 27 which supplies the energy needed to sustain ignition and combustion of the fumes emitted from batch furnaces 12*a*, 12*b* and 12*c* through fume ducts 21*a*, 21*b* and 21*c*. A start-up burner (not shown) can be used to supply additional products of combustion (via the burner's gas line) which may be required under certain operating conditions of incinerator 25. Thus, because system 10 will operate, as explained later, to generate a constant fume load throughout the pyrolyzing cycles, heat exchanger 27 in turn can generate a constant volume of a hot gas which in turn can at least partially replace the burners in the prior art rich fume incinerator while also assisting in the jet pump action of the cold combustion air causing mixing, ignition and stabilization of batch furnace fumes in ducts 21*a*, 21*b* and 21*c* at lee 48.

Figure 5:
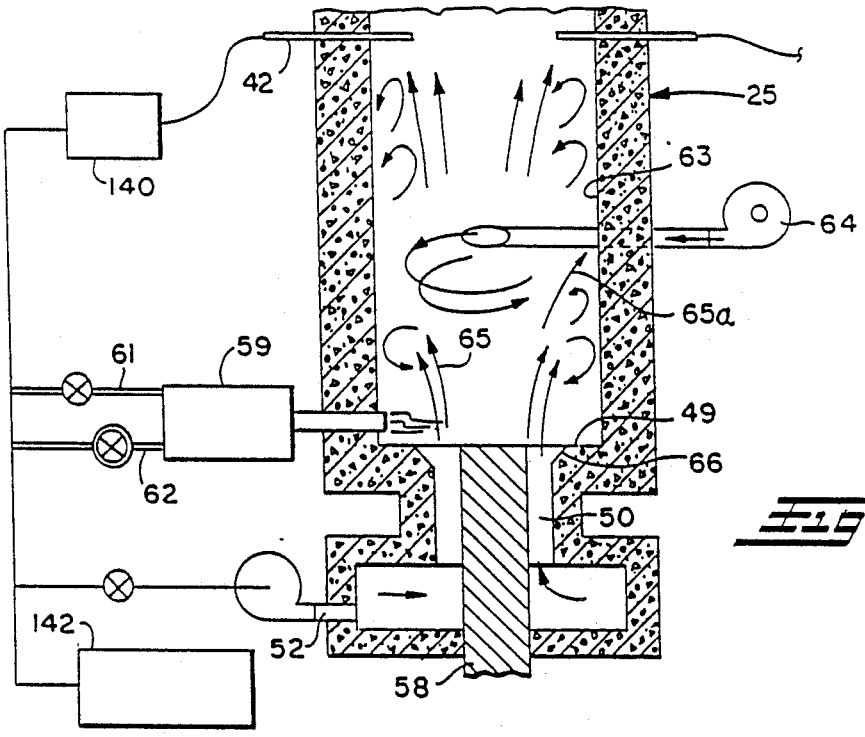
FIG. 5 is a partial, schematic, cross-sectional view of the incinerator shown in FIGS. 2 through 4 and illustrating the flow pattern of the fumes therein.

The preferred embodiment of afterburner 25 is schematically illustrated in FIG. 5 and in the preferred embodiment, numerals used with respect to FIGS. 2–4 will designate like parts in FIG. 5. Comparing the preferred embodiment of the incinerator to that disclosed in FIGS. 2–4, step 47 is deleted, cylindrical passage 53 is plugged as at 58 and at least one burner 59 is provided to fire its products of combustion into combustion chamber 36. Burner 59 has an air supply line 61 and a fuel supply line 62 which can be operated to direct fuel or air through burner 59 without actual firing of burner 59 in a manner similar to that disclosed in the prior art rich fume incinerator. The operation of incinerator 25 in FIG. 5 is, however, in marked contrast to that which occurs in the prior art rich fume incinerator. In the prior art incinerator cold air annulus 50 acted as a jet pump to pull fumes through what is now plugged passage 58 and the aspirated fume-air mixture was then expanded as a free jet in the form of a frusto conical cone to impact interior wall 39 of combustion chamber 36. A dead spot or lee 48 was thus established at annular step 49 whereat a portion of the air-fume mixture was stabilized, ignited and from which combustion was then propagated as the mixture traveled longitudinally along the length of combustion chamber 36. This, in effect, was a burner. In the afterburner of FIG. 5, the same result is accomplished but in a somewhat different manner. As already discussed, tangential fume ducts 21*a*, 21*b* and 21*c* pressurized by blower 64 establish a ring shaped band swirling about interior wall 39 of combustion chamber 36. In the process of swirling, the fumes in each fume duct 21*a*, 21*b* and 21*c* are mixing to produce a composite fuel mixture which depending upon content of the fumes may, in and of itself, be combustible. The composite fume mixture spreads axially or longitudinally along interior wall 39 with a portion of the composite mixture spreading towards annular step 49 and a portion of the composite mixture spreading axially away from annular step 49. The relatively cold combustion air in cold air annulus 50 enters combustion chamber 36 as a free-standing cold air jet designated by numeral 65 in FIG. 5. Depending upon the jet's velocity, the dimensions of the interior wall 63 relative to the diameter of cold air annular chamber 50, the angle of any relief formed in the interior diameter of step 49 as shown by reference numeral 66, etc., the frusto conical shape of cold air jet 65 in combustion chamber 36 can be controlled. Preferably, combustion air jet is controlled so that it impacts the annular swirling composite fume stream at a longitudinal distance coincident with the longitudinal distance or plane at which fume ducts 21*a*, 21*b* and 21*c* were introduced into combustion chamber 36, i.e. arrow 65*a*. This creates a turbulent reaction between cold air jet 65 and the swirling mass of composite fumes significantly enhancing the mixing of the stream. Thus, a portion of the composite fume stream along with a portion of the cold air jet stream 65 will mix into combustible mixture at lee 49 whereat ignition vis-a-vis burner 59 will occur and combustion of the mixture will propagate as the mixture travels the length of combustion chamber 36 vis-a-vis the effect of cold air jet 65. The burner principle thus utilized in the prior art fume incinerator is thus established in the modified afterburner 25 but in a manner in which all the fumes from all the pyrolyzers have been uniformly mixed in what is defined herein as a composite mixture prior to combustion. This permits controllability of fume streams composed entirely of varying amounts of volatiles so that if pyrolysis alone was all that was desired to be accomplished in system 10, then system 10 could operate in a very controllable stable manner. More importantly, if, as explained hereafter, burnout was also being accomplished in batch furnace 12, the system 10 would still operate and function in a manner to be described and this, heretofore, was not possible.

Figure 6:
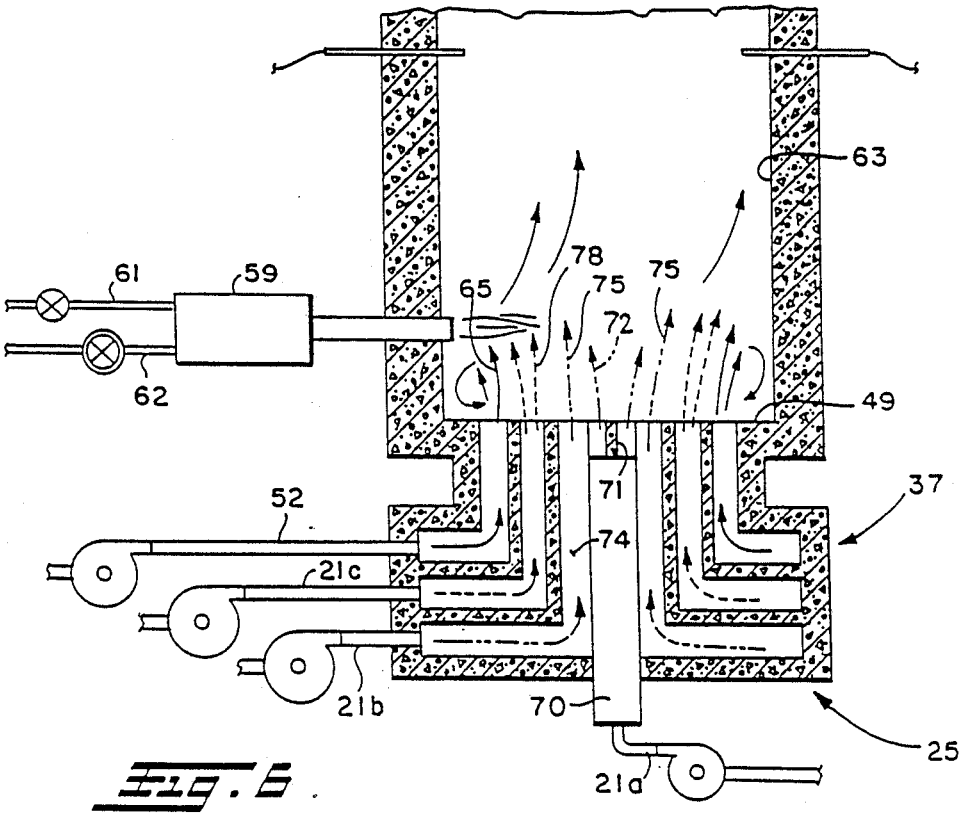
FIG. 6 is a view of an incinerator similar to that of FIG. 5 but illustrating an alternative design.

A still further alternative embodiment of the modified rich fume incinerator 25 is disclosed in FIG. 6 and, where applicable, identical parts and components will be designated by the same reference numerals heretofore used in identifying such items. The alternative afterburner design disclosed in FIG. 6 modifies inlet chamber 37 so that all the fumes as well as the combustion cold air is plumbed into the inlet end of incinerator 25 and, in this respect, is not entirely dissimilar to that of the rich fume prior art incinerator. In FIG. 6, a central passageway 70 is connected to one of the batch furnace's fume chambers shown as 21*a*. A centrally positioned insert 71 is provided so that an annular jet stream of fumes as illustrated by arrows 72 from first fume duct 21*a* enters the entry end of combustion chamber 36. Insert 71 is preferred, but in theory is optional and the jet developed in central passageway 70 could be a solid jet. A first annular chamber 74 surrounds central passageway 70 and is connected to second fume duct 21*b* for developing an annular jet stream of fumes, designated by arrows 75 in combustion chamber 36 from second batch furnace 12*b*. A second annular chamber 77 surrounds and is coaxial with first annular chamber 74 and in turn is in fluid communication with fume duct 21*c* to generate an annular stream of fume gases, designated by arrows 78 in combustion chamber 36, from third batch furnace 12*c*. Finally, cold air annulus 50 surrounds and is coaxial with second annular chamber 77 and develops an annulus of combustion cold air 65 at the entry end of combustion chamber 36. In operation, all jets, 65, 72, 75 and 78 expand as a single annular jet and impact interior wall 63 whereat turbulence and thus mixing of all jet streams occurs. The mixing continues as a portion of the imparted jet travels to step 49 whereat the composite mixture is ignited, combusted and controlled in a manner similar to that described and disclosed in greater detail in the prior art patents incorporated by reference herein. While the afterburner modification disclosed in FIG. 6 is believed functionally sound and adequate, the preferred modification shown in FIG. 5 is believed to promote a more thorough mixing of the composite fume streams and is thus preferred not only from a control standpoint but also from a stability view should burnout comprise an extensive step in the thermal processes practiced in batch furnaces 12.

SYSTEM OPERATION

Figure 7:
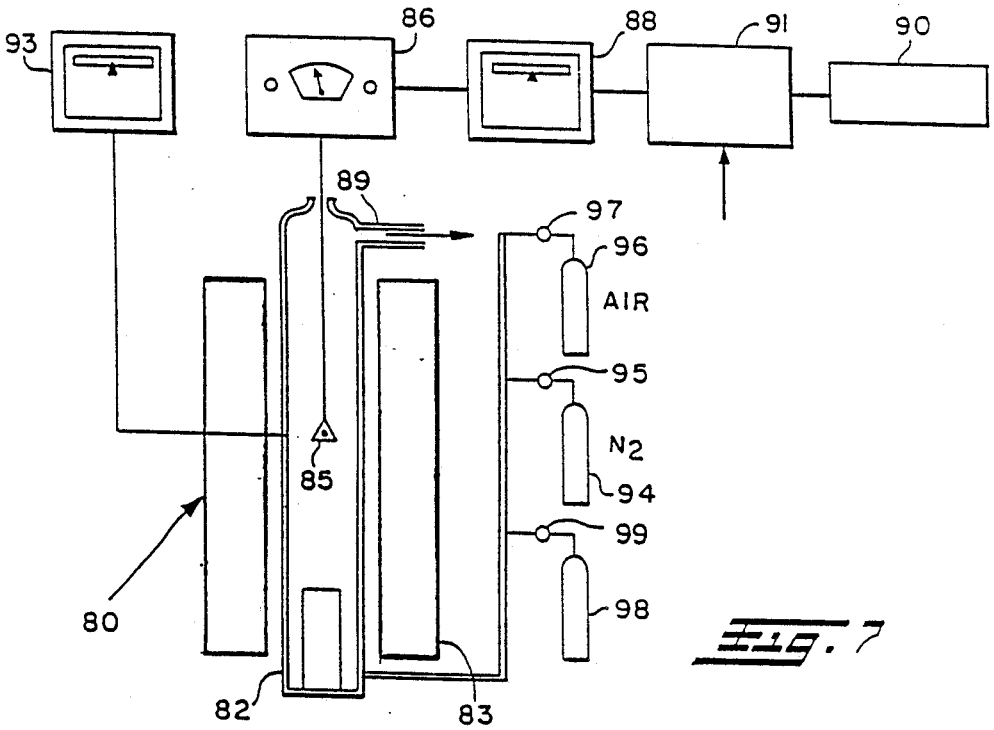
FIG. 7 is an illustration of a gravimetric furnace used in conjunction with the system of the present invention.
Figure 8:
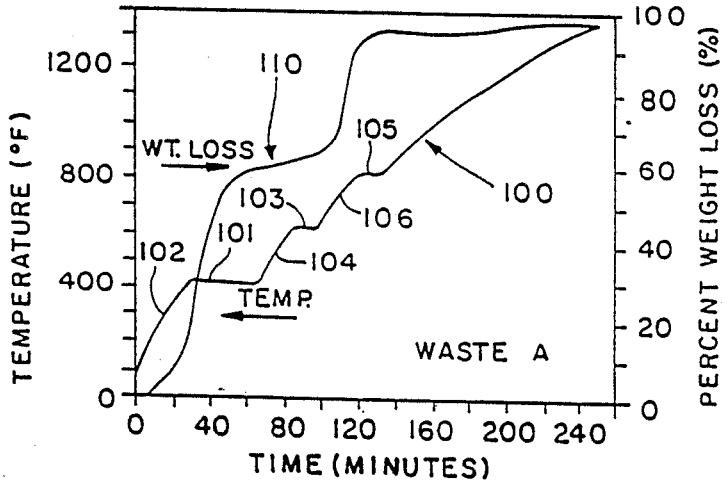
FIGS. 8 and 9 are graphs illustrating typical signature heat profile curves developed for two types of waste.
Figure 9:
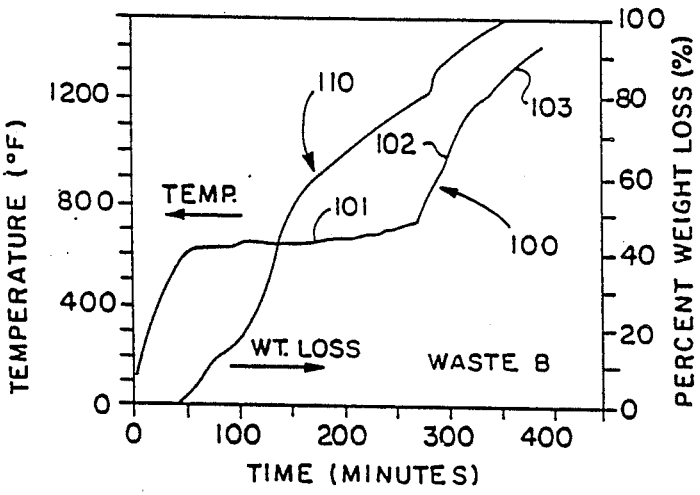

The system operation will first be explained by reference to what the inventors had heretofore accomplished with respect to system operation of a single batch furnace plumbed to a single afterburner and reference will be had to FIGS. 7, 8 and 9. In FIG. 7, there is shown in schematic form a thermal gravimetric furnace 80. Thermal gravimetric furnace 80 conceptually comprises a sealed furnace shell 82 which is indirectly heated by electric heating elements 83. A waste sample designated as 85 is placed in thermal gravimetric furnace 80 and accurately weighed by an electronic balance scale 86. Scale 86 in turn is connected to recorder 88 which then keeps a permanent record of the loss in the weight of sample 85 as it is heated in thermal gravimetric furnace 80. Waste sample 85 can either be a liquid, a sludge or a solid and when it is heated, the organic compounds of the sample are distilled or volatilized and the weight of the sample decreases until a residue or char is left. The volatiles driven off are analyzed by means of a gas analyzer 89 which includes, in addition to an analyzer 90 for determining the chemical composition of the fumes, a calorimeter 91 which determines the heating value, i.e. btu/hour of the fumes. Calorimeter 91 is connected to weight recorder 88 so that the fume heating value correlated to process time can be obtained along with sample weight loss. A controller 93 is provided to regulate heating elements 83 and the temperature within furnace shell 82. For purposes of this discussion, controller 93 also regulates an inert purge gas atmosphere, preferably a nitrogen source 94, through valve 95. Also, a source of oxygen 96 regulated by valve 97 is provided for a "burnout" of the residue after the volatiles have been driven off. "Burnout" is an exothermic reaction occurring in the presence of excess amounts of oxygen. Gas purge bottle 98 appropriately valved at 99 can be used in addition to or instead of nitrogen as the purge gas if desired. All of the components and sensing devices as thus described in FIG. 7 are known to those skilled in the furnace trade and will not be described in further detail herein.

As is well known, the chemical reactions during the pyrolysis process involve thermal decomposition, rearrangement of atoms in the molecule and polymerization of smaller molecules. These reactions are very complex and depend upon several factors such as the reaction time, the temperature, the composition of the waste material, catalytic effect which could exist between the container holding the waste and the waste, etc. Generally the reaction can be expressed as follows:

$$\text{organic waste} \xrightarrow{\Delta H} \underset{\text{(organics and } H_2O)}{\text{Volatiles}} + \text{Ash} + \underset{\text{(non-volatile carbonaceous)}}{\text{Char}}$$

Because there are many different, heterogeneous reactions occurring during the pyrolysis process and depending upon the complexity of the waste, the reactions can be competing, reactive or additive with one another at any given reaction.

Specifically, thermal gravimetric furnace 10 is used in the first instance to determine if various heterogeneous wastes can be pyrolyzed in a commercially meaningful sense. That is, can various temperatures over various times result in a sufficient weight loss of the sample to justify pyrolysis, i.e. can it be done. If pyrolysis can be done, then thermal gravimetric furnace 80 establishes, basically through a trial and error method, the optimum processing time-temperature relationship to produce maximum weight loss of the sample by thermal decomposition. This is best shown by pyrolysis graphs of two different wastes designated as "A" and "B" as shown in FIGS. 8 and 9. More particularly, there is shown a time-temperature graph 100 illustrating what furnace temperatures and for what time periods during which waste specimen 85 was pyrolyzed. There is also a graph indicating the percentage of weight loss resulting from thermal decomposition of waste specimen 85 during the time the specimen was heated. The objective is to drive the weight loss to as close to 100% as possible in the shortest time period. However, if this is done by simply ramping the temperature to higher values, the reaction will inevitably run out of control. As will be explained later, this is especially critical during the preheat step. The manner in which the reaction is controlled is to hold the temperature constant when the weight loss, i.e. the volatile reaction is rapidly occurring and then to step up the temperature when the specimen weight loss begins to slow in its rate. This results in temperature plateaus shown as 101, 103 and 105 in FIGS. 8 and 9 during rapid rates of weight loss and temperatures ramps shown as 102, 104 and 106 when the rate of weight loss of the specimen begins to diminish. Basically, temperature is ramped when weight loss rate is plateaued and temperature is plateaued when weight loss rate is ramped. In this way, the endothermic reaction in the pyrolyzing step can be controlled. The time-temperature and also weight loss-time curves are signature profiles which can be programmed into the furnace controls. Specifically, the burner firing rate in the batch furnace is programmed to establish time-temperature relationships in the batch furnace similar or identical to that established by thermal gravimetric furnace 80. While this is conventional with the inventors, the signature heat profile concept has not been used by other commercial pyrolysis systems. Those systems simply ramp temperature while measuring some characteristic of the fumes until an event occurs at which time the temperature is throttled back. Many wastes, especially the exotic heterogeneous compounds symbolic of toxic and/or hazardous wastes, have heat profiles generating rapid weight losses such that by the time a fume characteristic is sensed, the reaction has gone out of control. Thus, in the prior art systems, many waste compositions either cannot be pyrolyzed or they must be pyrolyzed at very slow temperatures increases to provide sufficient time to "catch" the reaction before a "runaway" occurs resulting in a total pyrolysis time significantly longer than that achieved by the present signature heat profile concept.

It is possible and, in fact, probable, that due to variations in waste composition when processing the waste on a commercial scale or, because of reactions between the drum and the waste or for any one of several other reasons, the commercial pyrolysis of the waste in a full-sized batch furnace will not exactly follow the signature heat profile. The inventors have heretofore provided a method to verify the fact that the heat profile is actually being followed by the waste batch being pyrolyzed in the furnace. As noted above with reference to the description of the thermal gravimetric furnace, the fume loading or heat value (btu per time) was calculated for the waste specimen. This data generates a signature fume loading profile. For a known commercial batch weight, the fume loading to be combusted by the prior art rich fume incinerator can be calculated. In the prior art rich fume incinerator, the combustion air was fixed at a constant rate. Before the present invention, the inventors varied incinerator combustion air flow rate in accordance with the signature fume load profile which in turn is established on the same time basis as the signature heat profile. Accordingly, should the commercial waste batch begin to heat excessively, the fume loading will increase over that established by the signature fume load profile and the exit temperature of the incinerator gases will increase. When this occurs, the prior art rich fume incinerator will adjust the air flow through the burner to insure incineration of the waste. At the same time, a microprocessor controller will retard the burner firing rate or the temperature in the batch furnace until the incinerator is able to combust fumes without the need for additional air through the burner. At that time, the signature profiles, both the heat profile and the fume loading profile, are reactivated and the process continued in its pre-programmed mode.

Figure 11A:
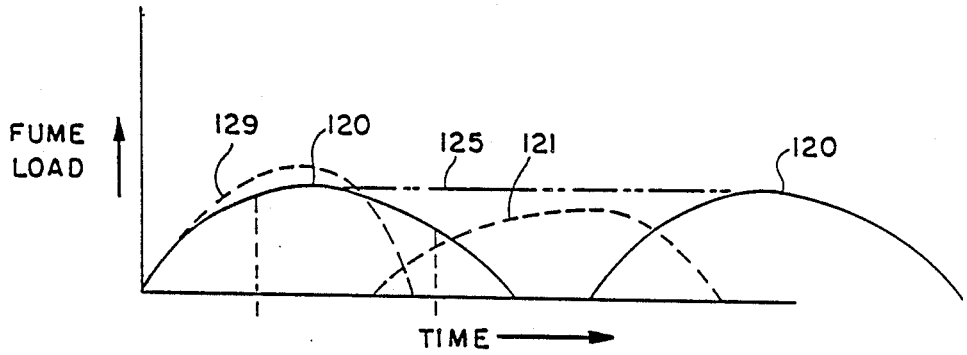
FIGS. 11*a* and 11*b* illustrate the sequencing of processing cycles for a two-furnace and three-furnace system, respectively.
Figure 11B:
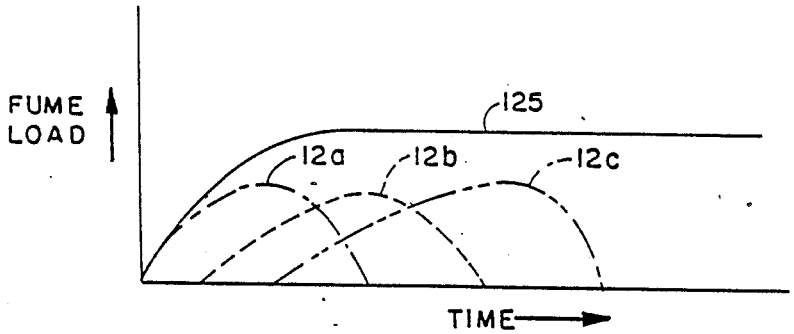

Referring now to FIGS. 11*a* and 11*b*, there is shown a fume loading cycle for a two and a three batch furnace system 10, respectively, of the present invention. As discussed above, for any thermal decomposition process conducted in batch furnaces 12 there is a preheat step in which the waste is heated (in an endothermic reaction with little oxygen) to the pyrolyzing temperature. This is followed by a pyrolyzing stage (again, an endothermic reaction with little oxygen) where the volatiles or organic compounds are driven off resulting in thermal decomposition of the waste followed by a burnout step which is essentially an incineration step usually conducted at elevated temperatures in the presence of excess oxygen and is always an exothermic reaction. The three process steps are indicated by lines shown relative to the profile of FIG. 11*a*. The objective then is to preheat as rapidly as possible until the point in time is reached where pyrolyzing begins.

Insofar as the fume loading profile or curve is concerned, for a majority of the waste, the profile assumes generally bell-shaped or inverted U-shaped configuration. The graphs of both FIGS. 11*a* and 11*b* are assuming, for explanatory purposes, that the same waste material is being treated in all the batch furnaces. Generally, what FIGS. 11*a* and 11*b* illustrate is that the multiple batch furnaces are being sequenced in an overlapping manner such that cumulative fume load on incinerator 25 as shown by lines 125 in FIGS. 11*a* and 11*b* is a relatively constant fume load value. To achieve this, the signature fume load profile or curve is flattened at the bight of the U-shaped curve which would otherwise normally occur if the waste was processed to achieve an optimum processing time, i.e. compare "normal" profile 129 with profile 120. This flattening also causes the signature heat profile to change. In practice, the overall processing time is not significantly increased and since the fume load curve is flattened, the transition from the preheat step to the pyrolyzing step occurs at a lower temperature than that which might otherwise occur. In the preheat step, water vapor is initially driven off and for most waste materials, it has been the experience of the inventors that at the point in time when the water vapor is substantially removed and the pyrolysis begins (in the sense that volatiles instead of water vapor are being driven off from the waste), there is a tendency for the reaction to "take off" or "run away". Thus, the overall process is under better control since there is less tendency for a runaway to occur in the preheat stage of the present invention.

By overlapping the processes in a sequential manner to generate a constant fume load as shown in FIG. 11, combustion air flow in the incinerator, can be at a constant volumetric rate resulting in an inherently more stable process than that of the single batch furnace—single afterburner prior art arrangement. Also, by sequencing the steps less need for the supply of additional combustibles through burners 59 is required. More particularly, the staging or overlap of the process is pre-established, and as best shown for the two furnace operation of FIG. 11*a*, the preheat step is overlapping the burnout step. When three furnaces are utilized, the preheat of one furnace overlaps the burnout step of another furnace while the third furnace is undergoing the pyrolysis step and in larger batch furnace applications, the overlap is occurring at temperature plateaus occurring in the signature heat profile. This sequencing permits the control scheme discussed above to be effectively utilized in the multiple batch furnace system 10 of the present invention. Should thermocouples 42 trigger an unacceptable fume loading condition, the process controller looks first to that batch furnace in its preheat stage and retards the firing rate for the burner for that furnace. If the condition is not corrected so that the appropriate signature profiles are reactivated, then the burner for the batch furnace in its pyrolyzing stage is retarded and finally, the temperature of the batch furnace in its burnout stage is reduced. Thus, a single unitary control, i.e. the thermocouple at the incinerator, is effectively utilized to control the complete thermal destruction process occurring in all the furnaces.

FIG. 11 illustrates system 10 processing similar waste. FIG. 12 illustrates the concepts employed in system 10 when batch furnaces 12 are processing wastes of different composition. It should be noted that it is a pyrolysis phenomenon that when furnace temperature decreases, fume loads as well as volatilization rates immediately decrease (provided a runaway condition is not present). FIG. 10*b* shows a signature fume load profile and curve 130 in FIG. 10*a* shows a signature heat profile corresponding to the waste in FIG. 10*b*. The particular waste indicative of the curve in FIG. 10*b* is a projectile or shell containing simulated chemical warfare agents and this accounts for the relatively high temperatures shown when compared to the other types of waste. FIG. 10*b* illustrates the normal bell shaped; fume loading curve which for purposes of illustration has not been flattened. FIG. 10*c* applies to a different waste and one in which the signature fume load profile is characterized by two distinct peaks or stages. That is, the endothermic, pyrolyzing step is occurring in two distinct volatilization stages. When two such wastes are pyrolyzed in a system such as diagrammatically illustrated in FIG. 11*a*, the dip in FIG. 10*c* will automatically result in the incinerator's controller modulating burner 59 and specifically air supply and fuel supply line 61, 62 to maintain the constant incineration temperature. That signal will also be sent to the feedback controller controlling the pyrobatch furnaces 12. If the feedback controller simply measured the rate of change (either fuel increase or decrease provided by the incinerator controller) a false reading will occur. This is overcome by having the feedback controller measure not only the fume loading trend, i.e. the rate of increase or decrease, but also measure the total fume load over the elapsed time period (i.e. integrating the fume load over time) so that a false decrease in fume load does not trigger a signal to start the next furnace in the sequence. In this manner, furnaces 12*a*, 12*b* and 12*c* are properly sequenced in a staged or overlapping manner to produce as nearly as possible the constant composite fume loading curve 125.

The controllers per se are microprocessors which use appropriate analog/digital conversions to program the appropriate process steps and issue the appropriate hardware commands. The microprocessors per se are conventional and do not in and of themselves comprise the invention. The controller scheme is diagrammatically shown in FIGS. 1 and 5 and includes an incinerator controller 140 which senses the temperature of the incinerator gases from thermocouples 42, 43 and regulates burner 59 including air supply line 61 or fuel supply line 62 to maintain the gases at their appropriate incineration temperature in incinerator 25. Incinerator controller 140 also sends its signal to a feedback controller 142. Feedback controller 141 is pre-programmed with the signature fume load profile and with the signature heat profile and controls, as a timed function combustion air in cold air inlet 52 while also receiving signals from incinerator controller 140 to determine rate of change in fume loading while also integrating the total fume load combusted. The fume loading data is then utilized by feedback controller 141, at the appropriate time, to interrupt the signature heat profile of any particular batch furnace 12*a*, 12*b* or 12*c* or to start and stop the appropriate batch furnace 12*a*, 12*b*, 12*c* in the appropriate sequence. Thus, the entire process is pre-programmed and in effect monitored only by incinerator thermocouples 42, 43. For safety reasons, oxygen sensors 143*a*, 143*b* and 143*c* are provided in batch furnaces 12*a*, 12*b* and 12*c* respectively as well as oxygen sensor 144 in incinerator 25 and all oxygen sensors are interconnected to feedback controller 142 to provide a system shut down feature. The shutdown feature is a necessary safety safeguard when combusting any potentially explosive mixture and generally comprises for batch furnaces 12 a water sprinkling system and the like.

The invention has been described with reference to a preferred embodiment. It will be obvious to those skilled in the art that modifications and alterations may be made to system 10 without departing from the spirit or the essence of the invention. It is our intention to include all such modifications and alterations insofar as they come within the scope of the present invention.

It is thus the essence of the invention to provide method and apparatus for a multiple batch furnace installation using only one afterburner to thermally process waste type materials in a sequentially staged overlapping manner which is easily controlled.

Having thus defined the invention, we claim:

1. A process for operating a pyrolysis type thermal decomposition system comprising the steps of:

(a) providing a plurality of batch type furnaces, (b) heating waste type materials in a controlled manner in each furnace where said materials produce fumes exhausted through a fume outlet on each furnace as said waste materials are decomposed by thermal reaction;

(c) providing one afterburner connected to the gas outlet of all of the furnaces for incinerating the fumes produced by said plurality of furnaces when said waste materials are heated in said furnace; and (d) operating said furnaces in a sequentially staged, overlapping manner to produce a generally constant supply of fumes to said afterburner.

2. The process of claim 1 wherein each of said furnaces is operated in a first step where the furnace temperature produces an endothermic reaction with said waste material until a residue remains, said first step producing fumes principally composed of volatiles with an oxygen content of no greater than about 2% and a second step where an exothermic reaction with said residue occurs to decompose said residue while producing a gaseous mixture of compounds and oxygen which is more than sufficient to support combustion of said compounds, and the fumes of both steps for each furnace being sent to said afterburner so that such afterburner is simultaneously incinerating (i) volatiles with insufficient oxygen to support combustion from one of said furnaces and (ii) compounds in a mixture having an oxygen concentration more than sufficient to support combustion from a second furnace.

3. The process of claim 1 wherein the temperature of said heating step is established at the instigation of said heating step at a value which produces a maximum rate of volatiles but which does not significantly exceed the volatile rate produced during the remainder of said cycle so that spiking of fumes do not occur and the heating process can be controlled.

4. The process of claim 1 further including the steps of (i) sensing the quantity of volatiles emitted by said waste material during said heating step and (ii) integrating the quantity of volatiles emitted by said waste material over an elapsed time period, and initiating said heating step for a second furnace only when rate of volatiles is decreased beyond a set limit and the integrated value at that time period is less than a predetermined value during said heating step for a first furnace.

5. The process of claim 1 further including the initial step of heating a sample of said waste material under controlled conditions to obtain a time-temperature relationship for said waste at an optimally constant energy rate in btu/hr of volume and varying the temperature of each of said furnaces over a time correlated to said time-temperature relationship to produce an optimally constant energy rate of volatiles for incineration by said afterburner.

6. The process of claim 1 further including the steps of providing said afterburner with a generally cylindrical combustion chamber having an annular base at one end;

introducing the fumes from each furnace tangentially to the interior of said combustion chamber at discrete, circumferential locations so that all of said fumes circumferentially swirl about the interior of said chamber;

introducing metered amounts of combustion air as a free standing jet adjacent said annular base end;

introducing metered amounts of combustibles as make-up fuel to said combustion chamber;

mixing said fumes from each furnace as said fumes swirl about said combustion chamber to produce a homogeneous fume mixture while mixing said combustion air with said swirling fume mixture as said free standing jet expands into said combustion chamber to produce a combustible fume mixture;

combusting said combustible fume mixture in said combustion chamber at a stable point of ignition generally adjacent said annular base and continuing said combustion as said combustible fume mixture travels the length of said combustion chamber away from said annular base end.

7. The process of claim 6 further including the steps of sensing the temperature of said combustible fuel mixture in said chamber at a point remote from said annular base end and controlling said make-up fuel to increase said fuel when said sensed temperature drops below a fixed value.

8. The process of claim 7 further including the additional step prior to controlling said make-up fuel of initially increasing said combustion air when said temperature drops below a fixed value until said combustion air reaches a fixed value whereat said step of controlling said make-up fuel becomes effective.

9. A pyrolysis system comprising a plurality of batch type pyrolyzing furnaces for heating waste to decompose same by thermal reaction, each furnace having a fume outlet whereby gaseous mixtures produced in each furnace exit therefrom;

a single afterburner in fluid communication with each fume outlet for incinerating the fumes produced by said plurality of furnaces irrespective of the gaseous mixture composition; and control means for operating said furnaces in a sequentially staged manner with overlapping cycles to produce a generally constant supply of fumes to said afterburner.

10. The pyrolysis system of claim 9 wherein each of said furnaces include means to heat said waste under an atmosphere controlled in oxygen content;

control means in said afterburner sensing the temperatures of said incinerated fumes, and controlling the operation thereof; and said control means is effective to (i) initially heat said waste in each furnace at predetermined temperatures correlated to the time at which said wastes are heated and (ii) overriding said predetermined temperature only by the temperature sensed by said control means in said afterburner.

* * * * *